United States Patent [19]

Lundgren

[11] Patent Number: 4,548,295

[45] Date of Patent: Oct. 22, 1985

[54] COUNTER SYSTEM

[75] Inventor: Gillis Lundgren, Lönashult, Sweden

[73] Assignee: Inter-Ikea AG, Lucerne, Switzerland

[21] Appl. No.: 477,075

[22] Filed: Mar. 21, 1983

[30] Foreign Application Priority Data

Mar. 22, 1982 [DK] Denmark ..... 1285/82

[51] Int. Cl.[4] ..... A47F 10/04

[52] U.S. Cl. ..... 186/63; 186/59

[58] Field of Search ..... 186/59, 62-65, 186/52, 26, 27, 29, 31-34

[56] References Cited

U.S. PATENT DOCUMENTS

| | | | |
|---|---|---|---|
| 2,368,986 | 2/1945 | Hem | 186/59 |
| 3,517,773 | 6/1970 | Swanson | 186/63 |
| 3,739,878 | 6/1973 | Jay | 186/63 |
| 4,007,809 | 2/1977 | Goransson | 186/63 |
| 4,298,099 | 11/1981 | Isaacs | 186/27 X |
| 4,327,819 | 5/1982 | Coutta | 186/62 |

*Primary Examiner*—Joseph J. Rolla
*Assistant Examiner*—Kevin P. Shaver

[57] ABSTRACT

A counter system comprising at least one counter and a plurality of shopping carts. The counter includes a cashier's section and a conveyor band for articles and assists in defining a passage for the carts to move past the cashier's section. The counter further has a receiving section having a height from the floor slightly greater than the loading surface of the carts from the floor and the passage has a width smaller than the shopping carts so that a cart can move in the passage only when it is perpendicular to the passage and its loading surface extends below the receiving section whereby the receiving section removes any articles present on the loading surface of the cart when it passes the system.

21 Claims, 13 Drawing Figures

COUNTER SYSTEM

Figure 1:
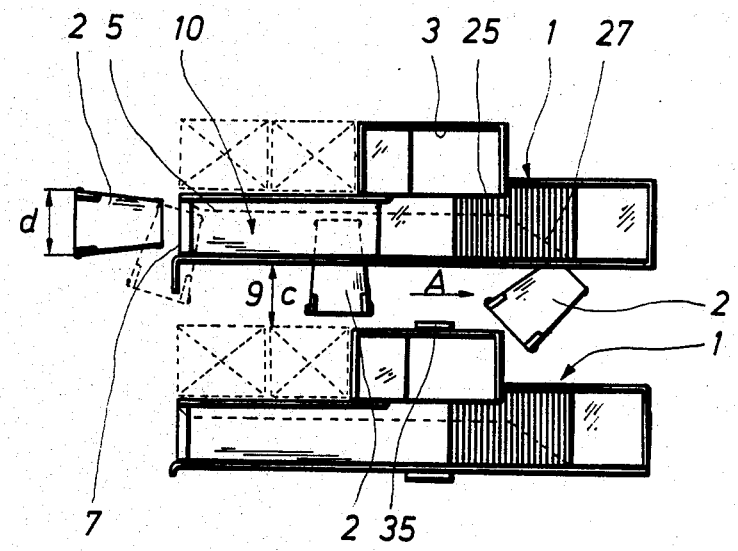

The invention relates to a counter system comprising at least one counter and a plurality of shopping carts, and whereby the counter includes a cashier's section as well as a conveyor band advancing the articles to said section, said counter co-operating in defining a passage, through which the carts are moved past the cashier's section.

A counter system of this type is known, which is made of a plurality of parallel counters at regular intervals, whereby a passage is formed between each pair of counters. Each counter includes a cashier's section, and when moving along the passage with his shopping cart each customer can pay at the cashier's section in said passage. However, it has turned out that some customers do not pay for all the articles at the cashier's section, but try to hide some articles so as to avoid payment thereof.

The object of the present invention is to provide a counter system of the above type, which in a very reliable manner prevents customers from passing the system with their articles without having paid for all said articles at the cashier's section.

The counter system according to the invention is characterized in that the counter comprises a bracket-shaped receiving section, the distance of which from the floor on which the system is situated is only slightly greater, preferably a few millimeters such as 4 millimeters, than the distance from the surface of the freely accessible loading surface of the cart to the floor, and that the passage is of a width slightly smaller than the width of the shopping cart in such a manner that the shopping carts can only be pushed forward manually in said passage when they are positioned perpendicular to the receiving section and their loading surface simultaneously extends below said section, whereby the receiving section removes the articles, if any, present on the loading surface of the cart when said cart passes the system. In this manner it is possible in a very efficient manner to ensure that all the customers pay for all their articles at the cashier's section since in order to pass the system together with the cart the customer must let the loading surface of the cart project under the bracket-shaped receiving section of the counter, whereby the articles are brushed off the loading surface. In order to proceed, the customer must transfer his articles to the conveyor band advancing said articles to the cashier's section, and furthermore the customer must push the cart forward manually through said passage. During the pushing forward of the cart, said cart must be positioned perpendicular to the longitudinal direction of the passage. While the cart is pushed through the passage, the greater part of its loading surface is covered by the receiving section. After having paid at the cashier's section, the customer presses his cart further forward until it is extricated from the receiving section. The counter system is particularly suitable for great voluminous articles because the loading surface of the shopping cart may comprise a great low loading surface for the transport of the articles. The system requires no extra employees compared to the known systems.

The access end of the receiving section may according to the invention be positioned perpendicular to the longitudinal direction of the passage, whereby the receiving section in a particularly efficient manner is capable of brushing off the articles from the loading surface of the cart, when said cart is pushed below the receiving section.

Moreover according to the invention, the access end of the receiving section may be rectilinear and form an abtuse angle with the longitudinal direction of the passage. As a result, it is more comfortable for the customer upon the brushing off of the articles since the access end faces partially the customer when the latter is to enter the passage.

According to the invention the conveyor may be in two parts. This embodiment of the system is particularly advantageous when the access end of the receiving section as previously mentioned forms an abtuse angle with the longitudinal direction of the passage.

According to the invention the receiving section corbels a distance greater than or equal to half the length of each shopping cart, said distance being measured in a direction perpendicular to the longitudinal direction of the passage, and a preferably adjustable auxiliary section is provided on the receiving section adjacent or on the access end thereof, said auxiliary section narrowing the passage locally and projecting transversely into said passage, whereby the auxiliary section is positioned a short distance above the surface of the loading surface of the cart and projecting so far into the passage that the receiving section plus the auxiliary section are capable of brushing off substantially the entire loading surface of the cart when said cart is transversely positioned and pushed forward in the passage. In this manner it is easier than previously for the customer to handle the cart through the system because he can always see a substantial part of the loading surface of the cart. He cannot, of course, see the part of the loading surface that projects below the receiving section.

The access end of the receiving section may according to the invention be provided with a preferably adjustable brushing off means such as a brushing off plate or hoop, which is optionally slightly resilient and optionally extends so far that it can brush off the loading surface of the cart. As a result it is ensured that the system is easily adjustable to the type of articles that are to be paid for. When it for instance is a question of articles of wood, care is taken that the brushing off means is of such a material and optionally rounded that it does not damage the articles to be paid for when said articles situated on the loading surface of the cart are brushed off said loading surface during the carting-in of the cart below the receiving section.

Furthermore according to the invention, the receiving section may along the passage be provided with a removable strip such as a metal strip. As a result, it is possible to remove the strip from the receiving section when an article present on the loading surface of the cart is very thin, e.g. of paper or fabric, and by accident is squeezed between the receiving section and the surface of the loading surface of the cart in such a manner that the cart cannot be moved immediately.

According to the invention, a brushing off member such as a strip or a brush may be provided inside or below the receiving section opposite the cashier's section, said member optionally being obliquely mounted and preferably of the rotating type for brushing off thin articles from the loading surface of the cart and for carrying said articles to the cashier's section. In this manner very thin articles, e.g. of paper or fabric, are brushed off the loading surface of the cart and moved to the cashier, if said articles had not been brushed off the loading surface of the cart at the access end of the receiving section. Subsequently, the cashier can settle these particular articles too.

According to the invention, it is furthermore rendered possible that the conveyor band can extend obliquely upwards on the receiving section from the access end thereof, and that the conveyor band is optionally angularly adjustable. In this manner the customer need only move the article a short distance at the brushing off of the article from the loading surface of the cart, viz. from said loading surface of the cart and a few centimeters upwards to the beginning of the conveyor band. Subsequently, the conveyor band advances the article obliquely upwards to the cashier's section. It is an advantage when the angle of inclination of the conveyor band is adjustable, since the conveyor band then is adjustable to the articles to be paid for. When it for instance is a question of very heavy articles, the angle of inclination is made relatively small.

Moreover according to the invention, the conveyor band may be defined by preferably high guide walls situated aside, the side walls for instance being solid or shaped as hoops, whereby the articles advanced on the conveyor band do not fall off said band easily.

According to the invention a guide or catching means, preferably a rail, may be provided in the spacing below the receiving section, said rail ensuring that each cart is maintained substantially perpendicular to the longitudinal direction of the passage during their movement past the cashier's section. As a result, each shopping cart is always easily guidable during the manual pushing forward through the passage in such a manner that it is positioned substantially perpendicular to the receiving section.

Furthermore according to the invention, the guide or catching means may comprise a carting-in section preferably of a small radius of curvature adjacent the access end of the receiving section, said carting-in section guiding or catching the end or wheel of the shopping carts at the initial moving of the loading surface of the cart below the receiving section. In this manner the cart slides into the correct position relative to the receiving section as soon as the customer reaches the access end of the receiving section. The cart maintains this correct position, i.e. perpendicular to the receiving section, during the entire passing through the passage.

According to the invention the guide or catching means may on or adjacent the place of the shopping cart is to be removed from the counter comprise a carting-out section, which for instance may be rectilinear and form an abtuse angle with the remaining portion of the guide or catching means or be curved, preferably along a circular arc of a great radius of curvature. As a result, each cart is turned when pushed forward in the passage by the customer, whereby finally it is almost parallel to the longitudinal direction of the passage.

Moreover according to the invention, the receiving section may opposite the cashier's section or slightly spaced therefrom include an end area optionally provided with plastic rollers collecting the articles to be cashed as well as optionally a second collecting end area for articles already cashed (seen in the advancing direction of the conveyor band). In this manner a sufficient room is provided for the articles to be paid for or which have already been paid for. The articles already paid for and present at the part of the counter opposite the receiving section balance the counter in such a manner that they balance relative to the articles present on the projecting receiving section.

Furthermore according to the invention, each cart may according to a sectional longitudinal view be substantially L-shaped and at the upper end of the L optionally provided with a relatively small shopping basket, a handle being provided at said upper end of the L, whereby each shopping cart is easy to handle.

According to the invention the passage may be defined on one side by the projecting side of the receiving section of a counter and on the other side by the back of a neighboring counter and/or a a substantially planar defining portion such as a wall or a rail immediately associated therewith. In this embodiment of the system the passage is provided in a particularly simple manner.

Moreover according to the invention, the auxiliary section narrowing the passage may be shaped as a hoop section extending from one of the guide walls along the conveyor band, said hoop section preferably projecting such a length that it permits exactly passage of the upper part of the shopping cart when the cart is positioned perpendicular to the long side of the receiving section. As a result it is obtained in a particularly simple manner that the customer must turn the cart 90° relative to the longitudinal direction of the passage at the beginning of the passage, whereby a more efficient brushing off of articles from the loading surface of the cart is ensured.

According to the invention, anchoring means for securing the counter to the floor are provided at the end of said counter which is farthest from the receiving section. In this manner the receiving section cannot be pressed downwards against the floor even at transport and settling of very heavy articles on the counter since the counter tilts. Furthermore according to the invention a mirror for an additional control by the cashier of the loading surface of a passing cart is provided in the passage in a position opposite the cashier's section to allow the cashier to ensure that the loading surface is empty. Thus the cashier can watch the part of the loading surface that projects outside the receiving section, whereby the cashier discovers quickly the articles, if any, that are tried to be smuggled out on the cart.

When the system includes only one counter, the passage may according to the invention be defined on one side by the projecting side surface of the receiving section and on the other side by a vertical wall portion or railing extending parallel to the receiving section. This embodiment of the system is particularly simple.

Finally according to the invention, a dividing member substantially as high as the hips such as a wall portion or a rail is mounted longitudinally in the passage, said dividing member guiding the carts at the end of the carts where said carts are provided with a handle. As a result, the half of the passage permitting carting in and out is separated from the half of the passage permitting passage of the customers. During the passing of a cart from the access end of the receiving section and to the cashier's section, a customer cannot pull the cart out of the receiving section. The dividing member makes such a pulling out impossible. It extends to a place after the cashier's section, seen in the longitudinal direction of the passage.

Figure 2:
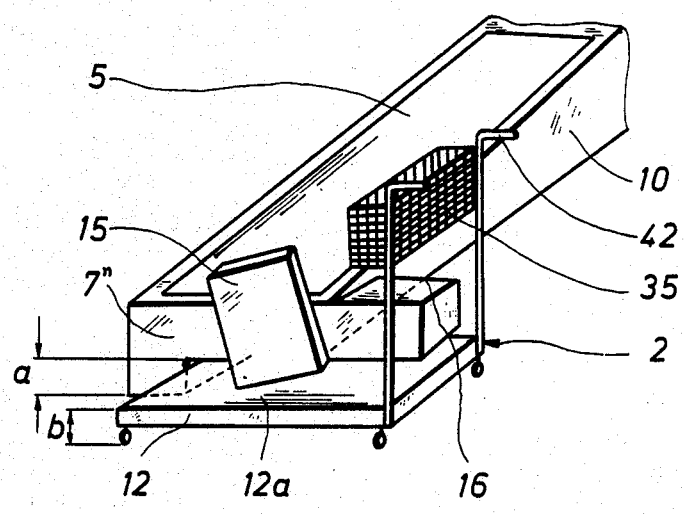
Figure 3:
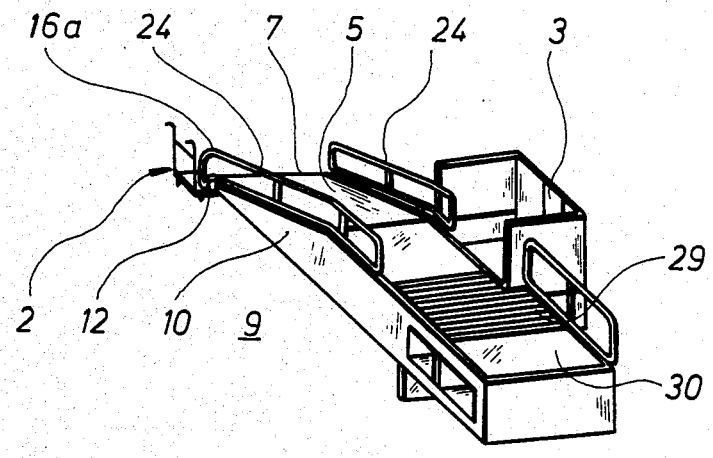
Figure 4:
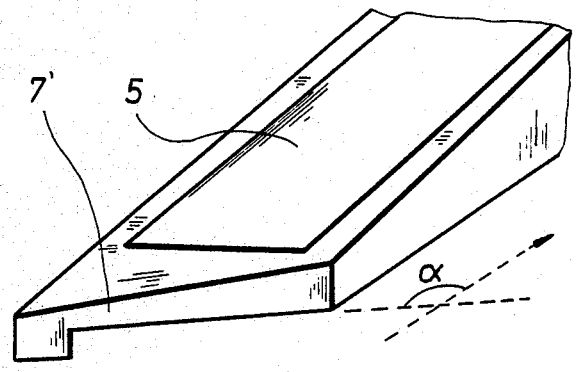
Figure 5:
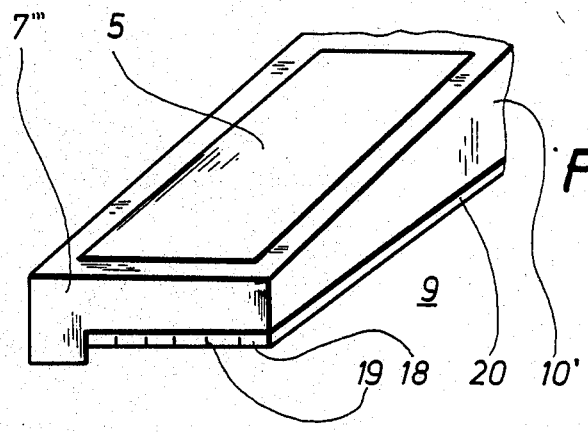
Figure 6:
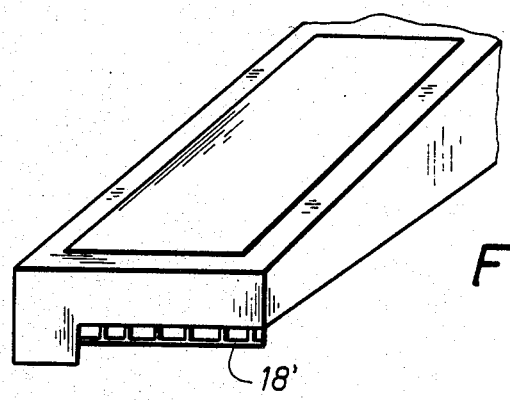
Figure 7:
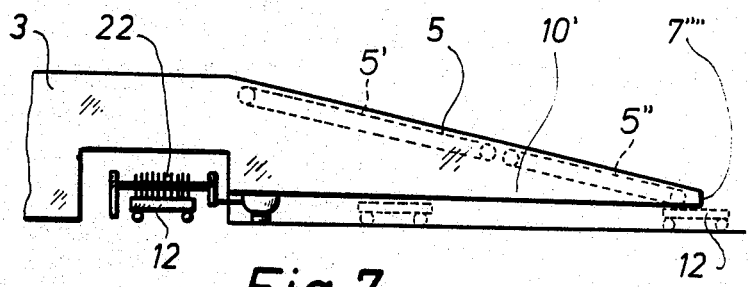
Figure 8:
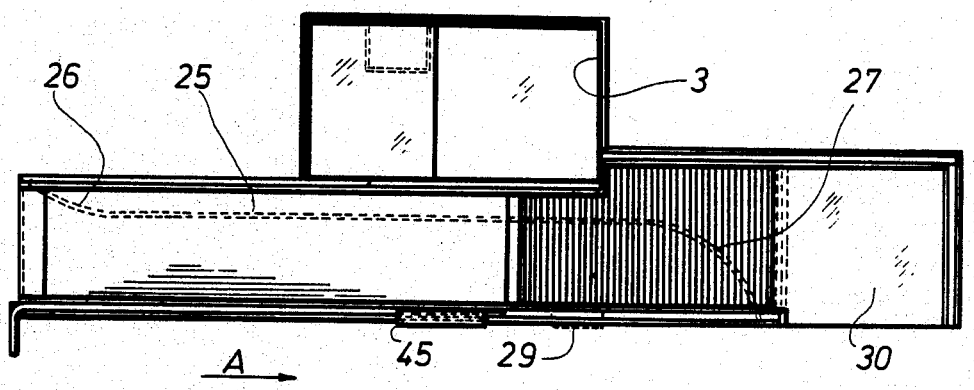
Figure 9:
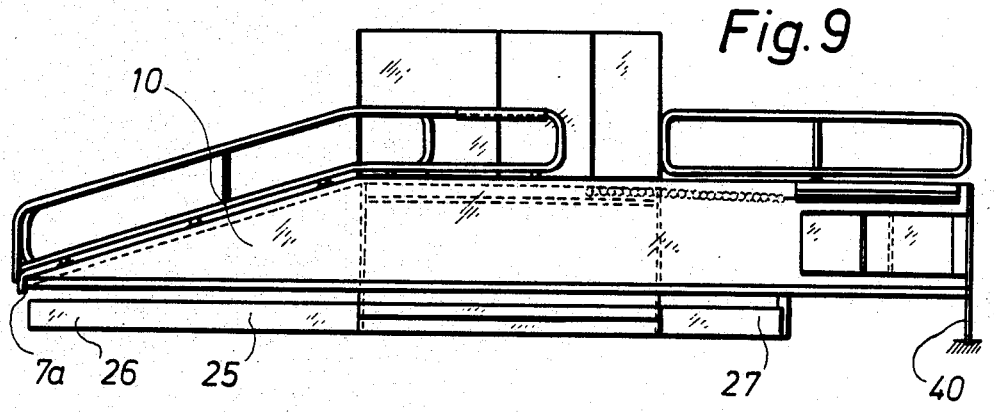
Figure 10:
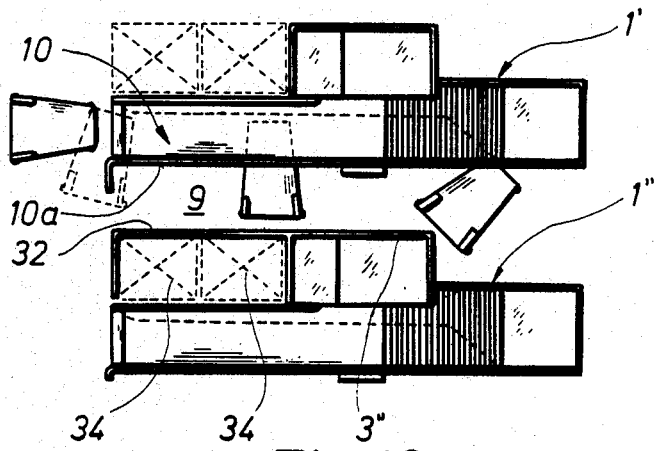
Figure 11:
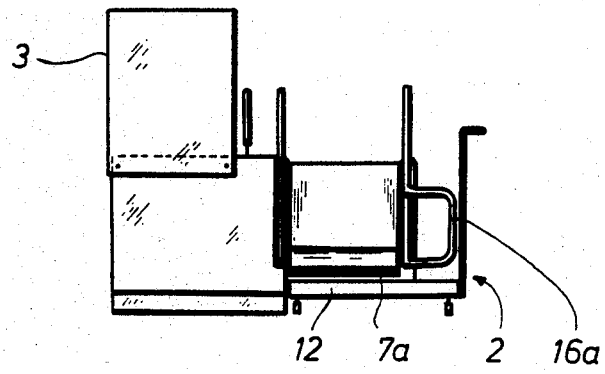
Figure 12:
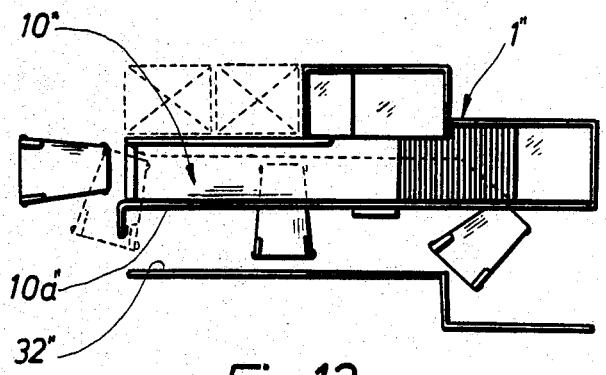
Figure 13:
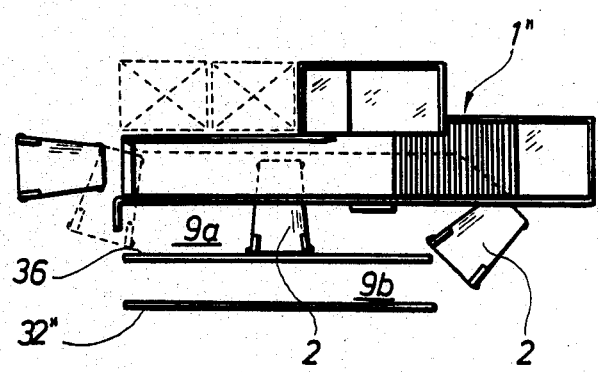

The invention will be described below with reference to the accompanying drawing, in which FIG. 1 is a top view of a first embodiment of a counter system according to the invention, whereby the system includes two counters and carts diagrammatically indicated, FIG. 2 is a perspective view of the access end of a counter, whereby it is illustrated how the loading surface of a shopping cart is pushed below the receiving section of the counter while an article present on the loading surface of the cart is brushed off said loading surface, FIG. 3 is a perspective view of a counter, FIG. 4 is a perspective view of the access end of the receiving section on a counter, whereby the access end is rectilinear and forms an abtuse angle with the longitudinal direction of the passage, FIG. 5 illustrates a rectilinear access end which forms an angle of 90° with the longitudinal direction of the passage, said access end being provided with an adjustable brushing off means in the form of a resilient brushing off plate, which as indicated may comprise tongues, FIG. 6 is a perspective view of an access end of a receiving section, the brushing off means being formed as an adjustable hoop, FIG. 7 illustrates part of a counter, seen from the cashier's section, whereby a brushing off member situated in the receiving section appears clearly, FIG. 8 is a top view of a further embodiment of a counter according to the invention, FIG. 9 is a side view of the embodiment of FIG. 8, FIG. 10 is a top view of a further embodiment of a system according to the invention, FIG. 11 illustrates the embodiment of FIGS. 8 and 9 of the counter, seen from the access end thereof, FIG. 12 is a top view of a final embodiment of the system according to the invention including only one counter, and FIG. 13 illustrates a counter with a passage in two parts.

The counter system illustrated in FIG. 1 comprises two counters 1 and a plurality of shopping carts 2. Each counter 1 includes a cashier's section 3, where an employee can sit at his cash register and cash the articles of the customers as said articles pass. Each counter 1 comprises a conveyor band 5 advancing the articles from the access end 7 of the counter to the cashier's section. A spacing is present between the two counters 1, said spacing forming a passage 9 permitting a forward passing of the carts. Each counter is as illustrated in FIGS. 2 and 3 provided with a receiving section 10, the distance a of which from the floor on which the system is positioned is only slightly greater than the distance b from the surface 12*a* of the loading surface 12 of the cart to the floor. The passage 9 is of a width c smaller than the width d of each shopping cart, cf. FIG. 1. Therefore each shopping cart can only be pushed forward manually in the passage 9 when they are positioned perpendicular to the receiving section 10 and their loading surfaces 12 simultaneously project below said receiving section. However, during such a pushing forward, the receiving section 10 brushes off the article(s) 15, if any, present on the loading surface 12. During this brushing off, the customer must catch the article and place it on the conveyor band in such a manner that it is advanced to the cashier's section for payment. The loading surface of the cart is freely accessible, i.e. at three edges it is free of side-restricting parts.

FIGS. 1 and 2 illustrate how the access end 7 forms a surface perpendicular to the longitudinal direction of the passage 9, as indicated at the arrow A.

As illustrated in FIG. 4, the access end of the receiving section of the counter may be obliquely cut and thereby form an abtuse angle $\alpha$ with the longitudinal direction of the passage, cf. the arrow B. The conveyor band 5 as shown in FIG. 7 may optionally be in two parts 5' and 5'', e.g. in such a manner that the two conveyor parts form an angle with each other.

As illustrated in FIG. 2, the receiving section 10 projects a distance greater than half the length of each shopping cart, said distance being measured in a direction perpendicular to the longitudinal direction of the passage, i.e. greater than half the length of the loading surface 12. As illustrated, the receiving section 10 is adjacent its access end 7'' provided with a preferably adjustable auxiliary section 16 projecting transversely into the passage and narrowing said passage locally. This auxiliary section is preferably adjustable in height and is positioned slightly higher than the surface 12*a* of the loading surface of the cart. Furthermore, this auxiliary section projects so far into the passage that the receiving section 10 plus the auxiliary section 16 may brush off substantially the entire loading surface 12 of the cart when the transversely positioned cart as shown is pushed forward in the passage. Usually the narrowed portion is of a width of about 50 centimeters. Then the customer realizes quickly that he cannot pass with a filled cart and that the cart must be turned for further advancing.

FIG. 5 illustrates a particular embodiment of the receiving section 10'. The access end 7''' of this embodiment is provided with a brushing off means 18 in the form of a brushing off plate. This plate may optionally be slightly resilient and optionally extend so far that it can scrape across the surface 12*a* of the loading surface 12 of the cart, cf. FIG. 2. The plate may project a short distance downwards as indicated to the left at 7*a* of FIG. 9. When the brushing off plate 18 is resilient, it may be provided with a row of notches 19 in such a manner that tongues are formed.

FIG. 5 illustrates how the receiving section 10' along the passage 9 may comprise a removable strip 20, e.g. of metal. This strip permits a quick extrication of the loading surface of the cart, if said cart should be squeezed below the receiving section because a thin article is clamped between the loading surface and the receiving section.

FIG. 6 illustrates a brushing off member formed as an adjustable hoop 18'.

FIG. 7 illustrates how a brushing off member for instance in the form of a strip or a brush may be mounted within the receiving section 10', seen from the back, viz. the cashier's section. In FIG. 7 the member is a brush 22 of the rotating type. The brush or strip may optionally be inclined. The strip or brush serve to brush off thin articles, if any, present on the loading surface 12 of the cart in spite of the brushing off procedure at the access end 7'''' of the receiving section.

FIG. 7 illustrates clearly how the conveyor band 5 may extend obliquely upwards on the receiving section 10' from the access end 7'''' of the latter. The conveyor band 5 may optionally be adapted in such a manner that its angle with the horizontal plane is adjustable.

FIG. 3 illustrates how the conveyor band 5 may be defined by preferably high guide walls 24 situated aside and for instance being solid or shaped as hoops. FIG. 3 illustrates hoop-shaped guide walls, and the spacings inside the hoops may optionally be filled with a plastic material so that the great rigid walls are formed. The side walls 24 serve to support the articles to be transported from the access end 7 of the receiving section 10 to the cashier's section. The guide walls 24 are of particular importance when the article to be transported upwards by the conveyor band 5 is of a width greater than the width of the conveyor so that the article must be transported upwards in an angular position, one end of the article supporting on the band 5 and the opposite end of said article sliding on one of the guide walls 24.

FIG. 8 illustrates a further embodiment of a counter according to the invention. A guide or catching means is as indicated by the dotted lines 25 mounted in the spacing between the receiving section 10 of this counter and the floor, and this guide or catching means may be formed as a rail. This rail forms a contact surface at the end of each loading surface 12 of the cart in such a manner that the cart can be maintained in a substantially perpendicular position relative to the longitudinal direction of the passage, cf. the arrow A, during the passing of the cart past the cashier's section 3. The rail 25 may either be suspended from the receiving section 10 or project from the floor below the receiving section. It is also possible that the guide and catching means 25 is formed by a longitudinal groove in the floor below the receiving section, and then the wheels of each cart 2 follows the groove. Two parallel grooves are preferably provided corresponding to the two pairs of wheels of the cart. The guide and catching means 25 may at the access end 7*a* of the receiving section 10 be provided with a carting-in section 26 guiding or catching the end or wheels of the shopping cart at the entering of the loading surface 12 of the cart below the receiving section 10. When the guide and catching means is a rail, the carting-in section 26 is also a rail optionally of a small radius of curvature.

On or adjacent the place where the shopping cart is removed from the counter, the guide or catching means 25 may comprise a carting-out section 27, which is curved, cf. FIG. 8. It may optionally be circularly curved, the radius of curvature being relatively great. The carting-out section may, however, also be rectilinear, cf. the dotted line at 27 in FIG. 1, and then it forms an abtuse angle with the remaining part of the guide or catching means.

FIGS. 3 and 8 illustrate how an end area 29 may be provided on the receiving section 10 opposite the cashier's section 3 or slightly spaced therefrom. This end area 29 is optionally provided with a plastic rollers and serve to collect the articles to be paid for at the cashier. Furthermore, a second collecting end area 30 collecting articles already paid for may be provided immediately adjacent the above collecting end area 29. As it appears, the articles on the end area 30 co-operate in balancing the counter, said articles often being relatively heavy. This is due to the fact that these articles prevent the projecting receiving section 10 from tilting downwards towards the floor when it is subjected to a very great vertical load for instance deriving from very heavy articles.

FIG. 2 is a perspective view of each cart showing that each cart is substantially L-shaped. At the upper end of the L, a handle 42 is present and adjacent this handle, a relatively small shopping basket optionally demountable is mounted.

FIG. 10 illustrates how the passage 9 may be defined on one side by the projecting side 10*a* of the receiving section 10 of one counter and on the other side by the back of a neighboring counter and/or by a substantially planar defining portion 32 in the form of for instance a wall or a railing immediately associated therewith. The portion 32 is usually connected to the wall in the cashier's section 3". Bargain articles and the like may, if desired, be displayed in the areas indicated by the crosses 34 in FIGS. 1 and 10, which, however, is irrelevant in connection with the present invention.

As indicated in FIG. 3, the auxiliary section narrowing the passage 9 may be shaped as a hoop member 16*a* projecting from the guide wall 24 adjacent the passage 9. The hoop member 16*a* projects preferably so far into the passage 9 that it permits exactly passing of the upper part of the shopping cart into the passage when the cart is positioned perpendicular to the long side of the receiving section 10.

As illustrated in FIG. 9, anchoring means 40 securing the counter to the floor may be mounted at the end of the counter which is farthest from the receiving section 10, i.e. at the outermost right end of the counter. In this manner a great securing of the counter not tilting is obtained when the receiving section 10 is loaded by very heavy articles.

As shown in FIG. 1, a mirror 35 may be mounted in the passage 9 opposite the cashier's section 3. This mirror provides the employee with an extra control that the loading surface of a passing cart is in fact empty, since the employee can watch the part of the loading surface of the cart not covered by the receiving section 10 by means of said mirror.

FIG. 12 illustrates a system including only one counter 1". The passage 9 of the system is defined on one side by the front side 10*a*" of the receiving section 10" and on the other side by a vertical wall portion 32" which is parallel to the receiving section 10".

FIG. 13 illustrates a system corresponding to the system of FIG. 12. However, in FIG. 13 the passage is divided into two halves 9*a* and 9*b* by means of a longitudinal dividing member 36 preferably as high as the hips. This dividing member may be formed by a wall portion or a railing and serves to guide the carts 2 at the end where they are provided with a handle while the carts are pushed through the system.

The invention may be varied in many ways without deviating from the scope of the invention. Thus the system may include a very high number of counters, e.g. 10–12 counters.

An advantage of all the embodiments of the system is that the customers must pay for all the articles on the carts before they leave the system and consequently the shop having installed the system.

I claim:

1. A counter system comprising at least one counter, a plurality of shopping carts each having a width and a loading surface for articles, said counter including a cashier's section as well as a conveyor band for advancing the articles to said section, and a passage defined in part by said counter through which the carts are moved past the cashier's section, characterized in that the counter comprises a receiving section having a lower overhanging portion at a distance from a floor on which the system is situated only slightly greater, preferably a few millimeters such as 4 millimeters, than a distance from the loading surface of a cart to the floor, said passage having a width slightly smaller than the width of the shopping cart such that the shopping cart can only be pushed forward manually in said passage when it is positioned perpendicularly to the receiving section and said passage and the loading surface of the cart simultaneously extends below said receiving section, the lower overhanging portion of said receiving section removing the articles, if any, present on the loading surface of the cart when said cart passes through the passage.

2. A system as claimed in claim 1, characterized in that the receiving section has an access end which is rectilinear and forms an obtuse angle with a longitudinal direction of the passage.

3. A system as claimed in claim 1, characterized in that the receiving section has a portion slightly spaced from the cashier's section which includes an end area provided with plastic rollers collecting the articles to be cashed and a second collecting end area for articles already cashed.

4. A system as claimed in claim 1, characterized in that each cart is substantially L-shaped and having at the upper end of the L a relatively small shopping basket and a handle.

5. A system as claimed in claim 1, characterized in that the passage is defined on one side by a front side of the receiving section of the counter and on the other side by a back of a neighboring counter.

6. A system as claimed in claim 1, characterized in that anchoring means for securing the counter to the floor is provided at one end of the counter.

7. A system as claimed in claim 1, characterized in that a mirror for additional control by the cashier of the loading surface of a passing cart is provided in the passage in a position opposite the cashier's section to allow the cashier to view the loading surface to ensure that the loading surface is empty.

8. A system as claimed in claim 1, characterized in that the passage is defind on one side by a front side surface of the receiving section and on the other side by a vertical wall portion extending parallel to the receiving section.

9. A system as claimed in claim 1, characterized in that a dividing member extends a vertical distance from the floor in the form of a wall and is mounted longitudinally in the passage, said vertical distance being substantially the same height of the counter, and said dividing member guiding the carts at the end thereof where said carts are provided with a handle.

10. A system as claimed in claim 1, characterized in that the receiving section corbels a distance greater than or equal to half the length of each shopping cart, said distance being measured in a direction perpendicular to a longitudinal direction of the passage, said receiving section having an access end and an adjustable portion adjacent said access end, said portion transversely extending into and narrowing the passage, whereby the portion is positioned a short distance above the loading surface of the cart and into the passage a distance such that the receiving section plus the portion are capable of brushing off substantially the entire loading surface of the cart when said cart is transversely positioned and pushed through the passage.

11. A system as claimed in claim 10, characterized in that the portion of the receiving section narrowing the passage is shaped as a hoop section extending from a guide wall along the conveyor band, said hoop section projecting a distance permitting close passage of an upper part of the shopping cart when the cart is positioned perpendicular to the longitudinal axis of the receiving section.

12. A system as claimed in claim 1, characterized in that the receiving section has an access end positioned substantially perpendicular to a longitudinal direction of the passage.

13. A system as claimed in claim 12, characterized in that the access end of the receiving section is provided with an adjustable brushing off means in the form of a plate which is slightly resilient and depends downwardly so that it can brush off the loading surface of the cart.

14. A system as claimed in claim 12, characterized in that the receiving section is provided with a removable metal strip along the passage to be removed when a thin article on the loading surface of the cart is accidentally squeezed beween the receiving section and the loading surface of the cart.

15. A system as claimed in claim 12, characterized in that a brushing off member in the form of a brush is provided inside the receiving section opposite the cashier's section, said member being obliquely mounted and of the rotating type for brushing off thin articles from the loading surface of the cart and for carrying said articles to the cashier's section.

16. A system as claimed in claim 12, characterized in that the conveyor band extends obliquely upwards on the receiving section from the access end thereof, and the conveyor band is angularly adjustable.

17. A system as claimed in claim 12, characterized in that the conveyor band has on each side high guide side walls which are shaped as hoops.

18. A system as claimed in claim 12, characterized in that a guide means in the form of a rail is provided on the floor below the receiving section, said rail ensuring that each cart is maintained substantially perpendicular to said longitudinal direction of the passage during its movement past the cashier's section.

19. A system as claimed in claim 18, characterized in that said guide means has a curvature adjacent the access end of the receiving section which guides an end of the shopping cart as it is initially moved beneath the overhanging portion of the receiving section.

20. A system as claimed in claim 19, characterized in that a location adjacent the cashiers section is where the cart is removed, the guide means being curved along a circular arc at said location to aid in the removal of the cart from beneath the overhanging portion of the receiving section.

21. A system as claimed in claim 1 or 12, characterized in that the conveyor band is in two parts.

* * * * *